US009580213B2

(12) United States Patent
Dong et al.

(10) Patent No.: US 9,580,213 B2
(45) Date of Patent: Feb. 28, 2017

(54) CHILD RESISTANT CLOSURE FOR A CONTAINER

(71) Applicant: Johnson & Johnson Consumer Inc., Skillman, NJ (US)

(72) Inventors: Ming Dong, Hoboken, NJ (US); Laszlo Moharita, Southampton, PA (US); Richard A. Lappine, Millville, NJ (US); Peter M. Zielinski, Millville, NJ (US)

(73) Assignee: Johnson & Johnson Consumer Inc., Skillman, NJ (US)

( * ) Notice: Subject to any disclaimer, the term of this patent is extended or adjusted under 35 U.S.C. 154(b) by 0 days.

(21) Appl. No.: 14/570,554

(22) Filed: Dec. 15, 2014

(65) Prior Publication Data

US 2016/0167838 A1 Jun. 16, 2016

(51) Int. Cl.

| | |
|---|---|
| ***B65D 50/02*** | (2006.01) |
| ***B65D 41/04*** | (2006.01) |
| ***B65D 45/28*** | (2006.01) |
| ***B65D 50/04*** | (2006.01) |
| *B65D 47/18* | (2006.01) |

(52) U.S. Cl.

CPC ..... *B65D 41/0492* (2013.01); *B65D 41/04* (2013.01); *B65D 45/28* (2013.01); *B65D 50/041* (2013.01); *B65D 47/18* (2013.01); *B65D 2221/00* (2013.01)

(58) Field of Classification Search

CPC ..... B29C 45/17; B65D 50/043; B65D 50/02
USPC ..... 215/220, 209, 221; 220/259.3, 259.4
See application file for complete search history.

(56) References Cited

U.S. PATENT DOCUMENTS

| | | | | |
|---|---|---|---|---|
| 2,980,274 | A | 4/1961 | Gould | |
| 3,472,409 | A | 10/1969 | Slack et al. | |
| 3,531,008 | A | 9/1970 | Achabal et al. | |
| 3,679,085 | A | 7/1972 | Gach | |
| 3,756,444 | A | 9/1973 | McIntosh | |
| 3,795,337 | A | 3/1974 | Nowaza et al. | |
| 3,888,375 | A | 6/1975 | Gerk | |
| 4,011,960 | A | 3/1977 | Mauvernay et al. | |
| 4,223,794 | A | 9/1980 | Morris | |
| 4,281,771 | A | 8/1981 | Siegel | |
| 4,330,067 | A | 5/1982 | Deussen | |
| 4,632,264 | A * | 12/1986 | Evans | B65D 50/041 215/220 |
| 4,635,806 | A | 1/1987 | Williamson | |
| 4,673,095 | A | 6/1987 | Puresevic et al. | |
| 4,832,218 | A | 5/1989 | Gibilisco | |
| 4,854,459 | A | 8/1989 | DeJonge | |
| 5,234,118 | A | 8/1993 | Fillmore et al. | |
| 5,280,842 | A | 1/1994 | Koo | |
| 5,509,550 | A | 4/1996 | DeJonge | |
| 5,678,718 | A | 10/1997 | Morris et al. | |

(Continued)

FOREIGN PATENT DOCUMENTS

| | | |
|---|---|---|
| EP | 1002737 A1 | 5/2000 |
| GB | 2100238 A | 12/1982 |

(Continued)

OTHER PUBLICATIONS

International Search Report—Int'l Appln. No. PCT/US2015/065299 dated Mar. 21, 2016.

*Primary Examiner* — King M Chu

(57) ABSTRACT

The present invention relates to a child resistant closure for a bottle or container. More specifically, the present invention relates to improved two-cap structure assemblies.

4 Claims, 4 Drawing Sheets

(56) References Cited

U.S. PATENT DOCUMENTS

| | | | | |
|---|---|---|---|---|
| 5,762,215 | A | 6/1998 | Ogden | |
| 5,769,252 | A | 6/1998 | Volpe | |
| 5,873,475 | A | 2/1999 | Volpe | |
| 6,105,802 | A | 8/2000 | French et al. | |
| 7,815,061 | B1 * | 10/2010 | Robinson | B29C 45/1676 215/220 |
| 8,316,622 | B2 | 11/2012 | Jajoo et al. | |
| 2007/0199912 | A1 * | 8/2007 | Libohova | B65D 50/048 215/220 |
| 2008/0142468 | A1 * | 6/2008 | Delagrange | B65D 47/0804 215/209 |
| 2011/0139742 | A1 * | 6/2011 | Brozell | B65D 50/041 215/220 |
| 2012/0138561 | A1 * | 6/2012 | Brozell | B65D 50/041 215/220 |

FOREIGN PATENT DOCUMENTS

| | | | |
|---|---|---|---|
| JP | 2009 208782 | A | 9/2009 |
| WO | WO 2013/190723 | A1 | 12/2013 |

* cited by examiner

CHILD RESISTANT CLOSURE FOR A CONTAINER

FIELD OF THE INVENTION

The present invention relates to a child resistant closure for a bottle or container. More specifically, the present invention relates to improved two-cap structure assemblies.

BACKGROUND OF THE INVENTION

It is well recognized that there is potential hazard, particularly for young children, if they are able to remove the closure cap from a bottle or container which may contain medicine or a toxic material or the like. Child resistant packaging or CR packaging is special packaging used to reduce the risk of children ingesting dangerous items. This is often accomplished by the use of a special safety cap. It is required by regulation for prescription drugs, over-the-counter medication, pesticides, and household chemicals.

Recently, there has been a desire to create child resistant safety caps for other consumer products such as eye drops. These products are often sold in small packages. Eye drops, for example, are often sold in containers as small as 5 to 20 milliliters. The packages often have eye droppers attached to their open end for dosing the container contents.

Child resistant safety caps often comprise a two-cap structure or closure. The "two-cap" structure being a structure or closure having an inner closure cap and a separate, non-interconnected, non-integral outer cap, the caps rotatable with respect to each other and both having interengaging components so that rotation of the outer cap in a clockwise direction will simultaneously and in unison rotate the inner cap to readily secure the inner cap to the neck of a bottle or container. The inner cap, however cannot be unthreaded or disengaged from the neck of the bottle or container unless an axial or a radial manual pressure is applied against the outer cap to produce an interengagement between the engaging means on the inner and outer caps so that they operate in unison when rotated counter-clockwise to thereby disengage the inner cap from the container. When an axial pressure is applied against the outer cap to produce the interengagement, the cap is known as a push-and-turn child resistant closure. When a radial pressure is applied against the outer cap to produce the interengagement, the cap is known as a squeeze-and-turn child resistant closure.

These two-cap structures are typically large in size when compared to those used for small containers such as dropper containers (e.g., eye or ear drop containers). Because of this typically "larger" size, mechanistic deficiencies in the two-cap structures may be less noticeable than in smaller two-cap structures. Therefore, there is a need for child resistant safety caps improving the mechanical interaction of the two-cap structures whether large in size or smaller in size—such as for dropper containers.

SUMMARY OF THE INVENTION

The present invention relates to closures comprising:

an inner shell comprising:

a. a first upper portion having an outer surface; and b. a first lower portion comprising an annular side wall depending downwardly from an outer periphery formed by the first upper portion, the annular side wall of the first lower portion having an outer surface and a first inner surface, the outer surface of the first lower portion comprising one or more inner shell cams projecting outwardly from the outer surface;

an outer shell rotatably housing the inner shell, the outer shell comprising:

a. a second upper portion having an inner surface;

b. a second lower portion comprising an annular side wall depending downwardly from an outer periphery formed by the second upper portion, the annular side wall having a second inner surface comprising:

i. outer shell side wings projecting inwardly from the second inner surface and disposed substantially within a plane for engaging one or more inner shell cams, the plane defining an acute angle with the second inner surface, the side wings bendable outwardly toward the second inner surface; and ii. wing recess areas disposed within the second inner surface and adjacent to the outer shell side wings to receive the outer shell side wings once the outer shell side wings are bent outwardly toward the second inner surface.

The present invention further relates to methods of reducing friction between outer shell side wings and inner shell cams in closure, comprising the steps of:

providing an inner shell comprising:

a. a first upper portion having an outer surface; and b. a first lower portion comprising an annular side wall depending downwardly from an outer periphery formed by the first upper portion, the annular side wall of the first lower portion having an outer surface and a first inner surface, the outer surface of the first lower portion comprising one or more inner shell cams projecting outwardly from the outer surface;

providing an outer shell comprising:

a. a second upper portion having an inner surface;

b. a second lower portion comprising an annular side wall depending downwardly from an outer periphery formed by the second upper portion, the annular side wall having a second inner surface comprising:

i. outer shell side wings projecting inwardly from the second inner surface and disposed substantially within a plane for engaging one or more inner shell cams, the plane defining an acute angle with the second inner surface, the side wings bendable outwardly toward the second inner surface;

providing wing recess areas disposed within the second inner surface and adjacent to the outer shell side wings to receive the outer shell side wings once the outer shell side wings are bent outwardly toward the second inner surface; and rotatably housing the inner shell within the outer shell.

BRIEF DESCRIPTION OF THE DRAWINGS

An embodiment of this invention will now be described in greater detail, by way of illustration only, with reference to the accompanying drawings, in which.

DETAILED DESCRIPTION OF THE INVENTION

The term "comprising" (and its grammatical variations) as used herein is used in the inclusive sense of "having" or "including" and not in the exclusive sense of "consisting only of" The terms "a" and "the" as used herein are understood to encompass the plural as well as the singular.

All documents incorporated herein by reference are only incorporated herein to the extent that they are not inconsistent with this specification.

The invention illustratively disclosed herein may suitably be practiced in the absence of any element which is not specifically disclosed herein.

The present invention relates to a child resistant closure for a small bottle or container, such as containers used for eye drops. The child resistant closure is a two-cap structure comprising an inner shell and an outer shell. The inner shell acts as a cap to prevent leakage of the product from the container. The outer shell is coupled to the inner shell. The child resistant closure is coupled to the container, usually by threads on the inner surface of the inner shell which match threads on the outer surface of the neck of the container. In the case of an eye drop product, the container often has an eye dropper fitment coupled to the neck of the container.

Figure 1:
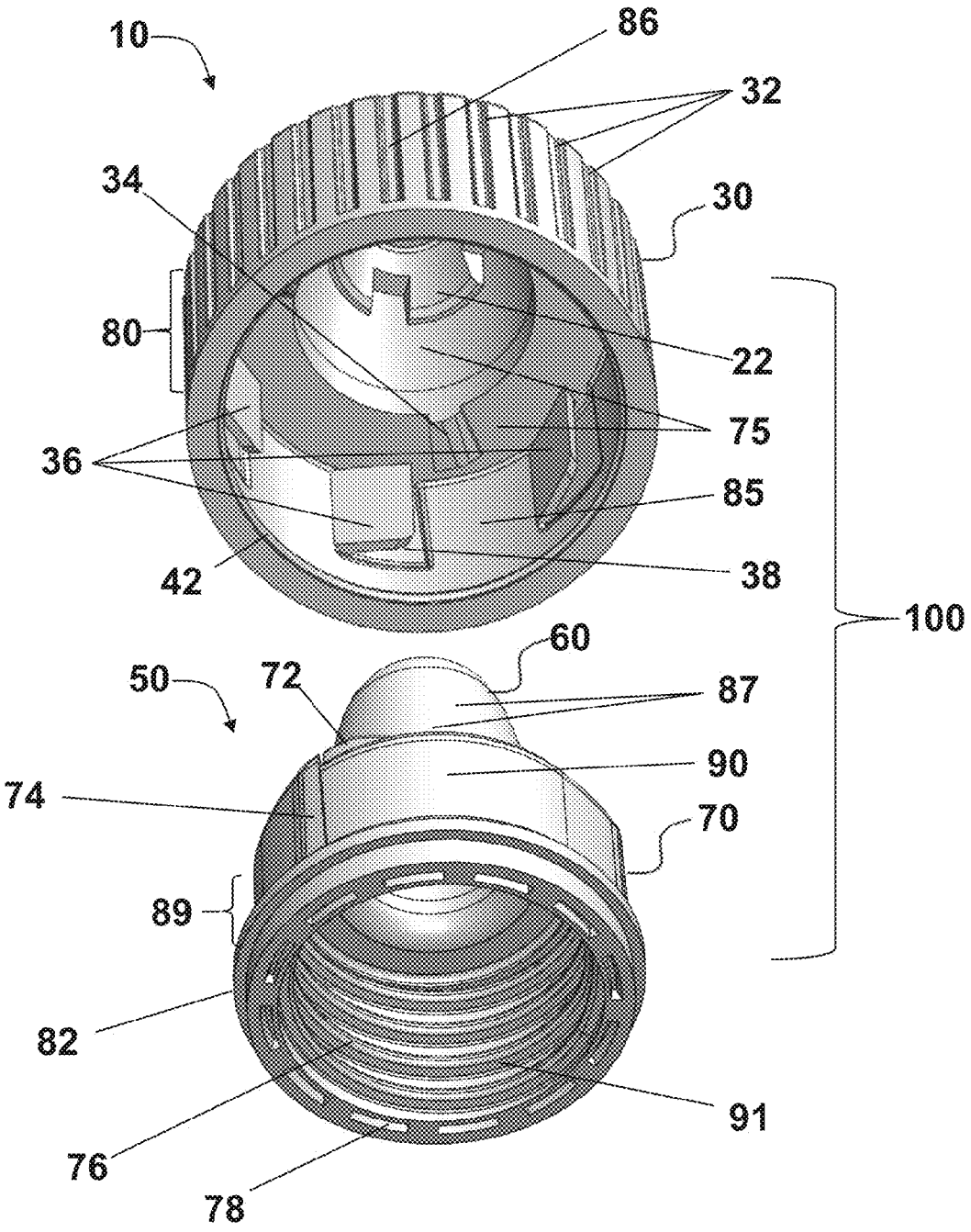
FIG. 1 is an exploded view of the safety closure of the present invention.

FIG. 1 illustrates the safety closure 100 of the present invention. Safety closure 100 generally includes an outer shell 10 and an inner shell 50.

Figure 2A:
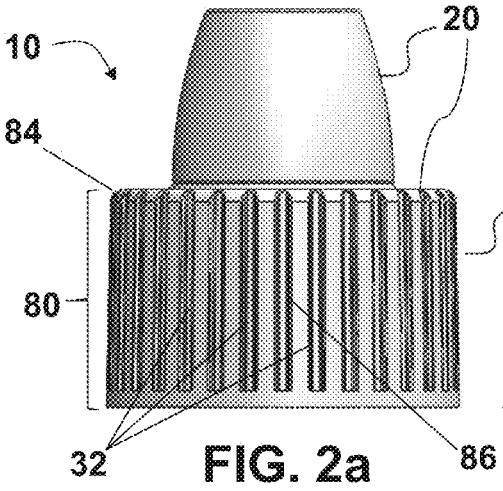
FIG. 2*a* is a side perspective view of the outer shell of the closure of FIG. 1.
Figure 3A:
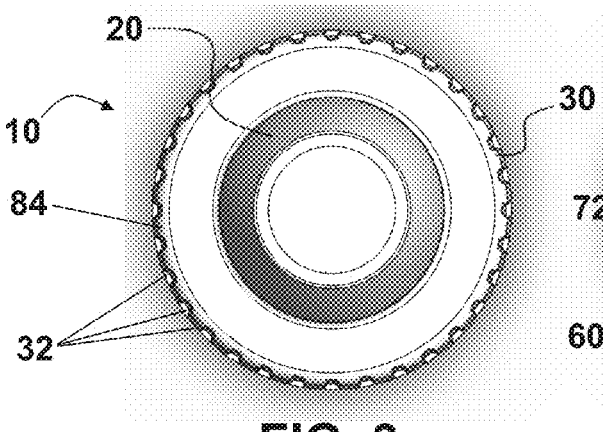
FIG. 3*a* is a top plan view of the outer shell of FIG. 2*a;*
Figure 4A:
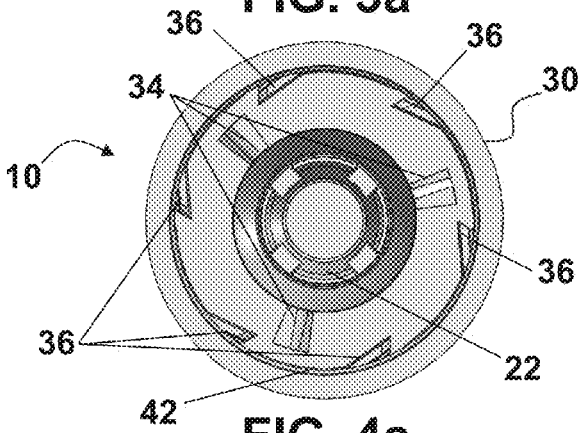
FIG. 4*a* is a bottom plan view of the outer shell of FIG. 2*a;*
Figure 5A:
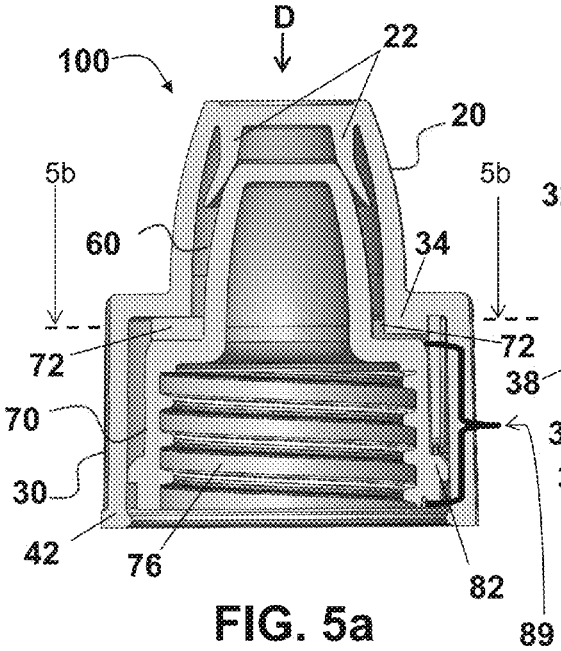
FIG. 5*a* is a fragmentary cross-sectional view of the safety closure of the present invention when a user is attempting to remove the closure from a container.
Figure 6A:
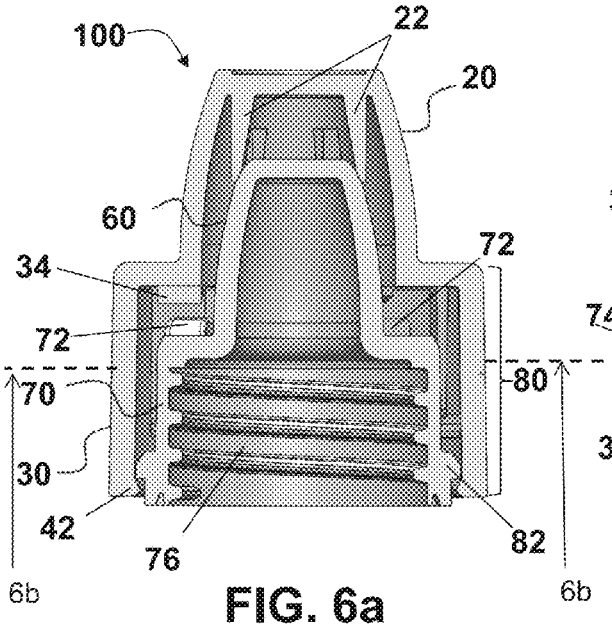
FIG. 6*a* is a fragmentary cross-sectional view of the safety closure of the present invention when a user is attempting to reengage the closure to a container.

Outer shell 10 is shown in perspective view in FIG. 1, and in side, top, and bottom views in FIG. 2*a*, FIG. 3*a*, and FIG. 4*a*, respectively. Outer shell 10 has an upper portion 20 and a lower portion 30. The upper portion 20 of outer shell 10 has an inner surface 75. In certain embodiments, upper portion 20 is a substantially flat top wall of outer shell 10. In certain embodiments, the outer shell 10 is movable from a first non-engagement position (as shown in FIG. 6*a*) to a second engagement position (as shown in FIG. 5*a*) relative to inner shell 50 of safety closure 100 for removal of the safety closure 100 from the container. Optionally, this movement is reversible. In other embodiments, the upper portion 20 of outer shell 10 contains a spring mechanism 22 projecting inwardly from the inner surface 75 of upper portion 20 to contact the inner shell 50 and automatically reverse movement (as described above) of the outer shell 10 away from the inner shell 50, from the second engagement position (as shown in FIG. 6*a*) back to the first non-engagement position (as shown in FIG. 5*a*) relative to inner shell 50 of safety closure 100 after removal of the safety closure 100 from the container. In one embodiment, as shown in FIG. 6, the spring mechanism 22 comprises at least one flexible arm or panel. Alternatively, the spring mechanism could be a flexible hinge Flexible hinges useful as spring mechanisms for the present invention can be found at col. 2, lines 12-34 of U.S. Pat. No. 8,316,622 to Jajoo et al., which portion is herein incorporated by reference; additionally, the remainder of U.S. Pat. No. 8,316,622 is also herein incorporated by reference. In certain embodiments, the spring mechanisms can include, but are not limited to plastic or metallic spiral spring structures or elements. In other embodiments, as shown in the figures, upper portion 20 is generally frustoconical in shape. After removal of the closure, top spring mechanism 22 forces outer shell 10 back to its non-removal position (as shown in FIG. 6*a*). The frustoconical shape of upper portion 20 in this embodiment serves as head space for certain embodiments of the inner shell 50 and a frustoconical eye dropper fitment coupled to the neck of the container to which safety closure 100 in coupled. The upper portion 20 contains one or more outer shell ratchets 34 projecting inwardly from the inner surface 75 of upper portion 20 of outer shell 10.

Figure 7:
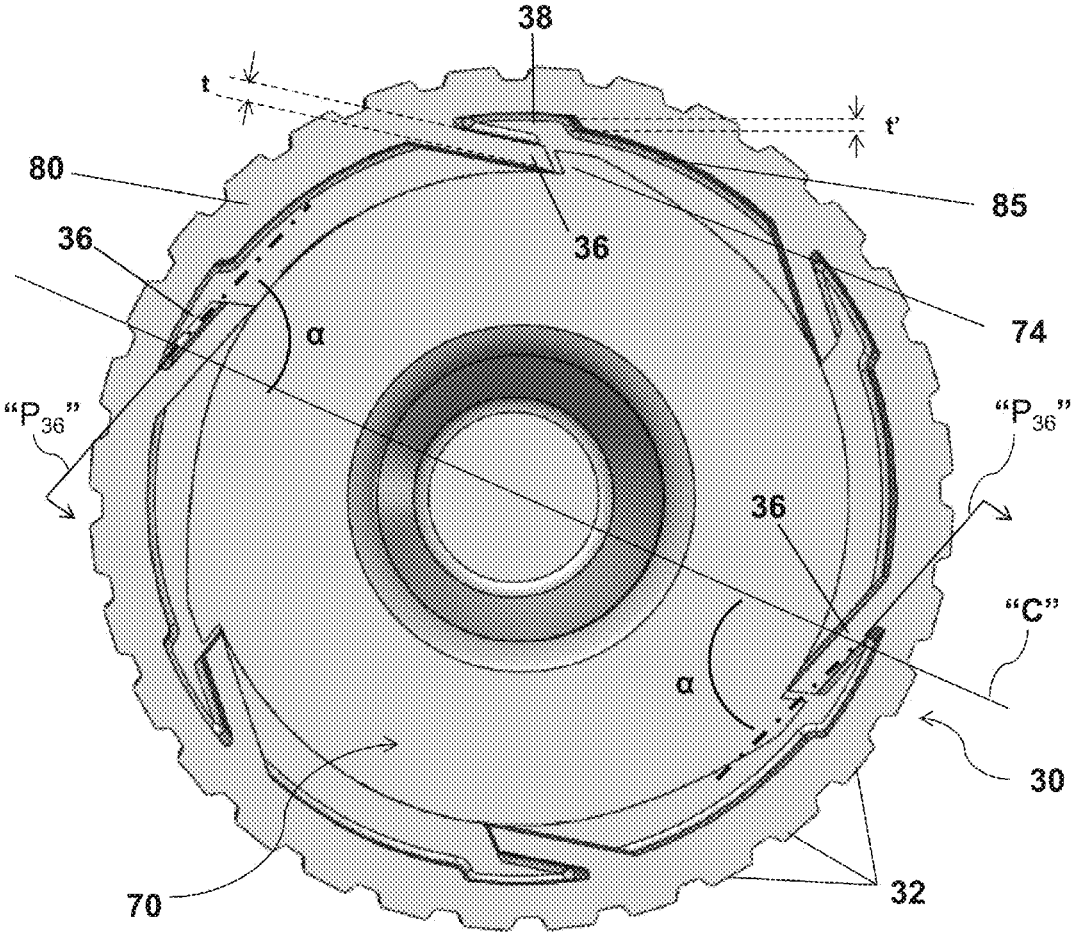
FIG. 7 is the cross-sectional view of FIG. 6*b* of the safety closure of the present invention, showing thickness t of outer shell side wings 36, depth t' of wing recess areas 38 angle "α", planes "$P_{36}$" and central axis "C".

Lower portion 30 of outer shell 10 is defined by an annular side wall 80 depending downwardly from an outer periphery 84 formed by the upper portion 20 of outer shell 10. The annular side wall 80 having an inner surface 85 and outer surface 86. The lower portion 30 is cylindrical in shape, and contains one or more inwardly projecting, bendable outer shell side wings 36, and an outer shell retainer segment 42 projecting inwardly from inner surface 85 of the annular side wall 80 of outer shell 10. The outer shell also comprises side wings 36 which project inwardly from the inner surface 85 of annular side wall 80 and are disposed substantially within a plane, the plane defining an acute angle with inner surface 85 of annular side wall 80. In certain embodiments, as shown in FIG. 7, outer shell side wings 36 project inwardly from the inner surface 85 of annular side wall 80 along respective planes "$P_{36}$" respectively offset from the inner surface 85 of annular side wall 80 by an angle equal to 90° minus "α" where "α" is the angle at which planes "$P_{36}$" are, respectively, offset from central axis "C". In certain embodiments, angle "α" ranges from about 45° to about 75°, optionally from about 50° to about 70°, optionally from about 55° to about 65°.

Lower portion 30 of outer shell 10 is cylindrical in shape as safety closure 100 will be rotated counter clockwise (CCW) during removal of safety closure 100 from the container, and clockwise (CW) during secured reengagement of safety closure 100 to the container. In certain embodiments, the closure of the present invention contains grip aids, as exemplified as axial ribs 32, texturing grip aids on the outer surface 86 of annular side wall 80. Though shown in the figures, the axial ribs 32 (which may also be in the form of slots or kurns or other texturing), are optional and are used to enhance the user's grip for rotating and/or removing the safety closure 100 relative to or from the container.

Outer shell ratchets 34 are shown on the inner surface 75 of upper portion 20 of outer shell 10. The function of ratchets 34 is to engage with inner shell ratchets 72 on outer surface of upper portion 60 of inner shell 50 during removal of safety closure 100 from the container. In some embodiments, outer shell ratchets 34 are prism shaped. In the embodiment shown in this disclosure, ratchets 34 are shown as prism shaped with an inclined plane on one side and flat side opposite the inclined. Outer shell ratchets 34 are positioned so that the flat side of outer shell ratchets 34 engage with inner shell ratchets 72 during removal of safety closure 100 from the container. The side of the outer shell ratchets 34 having the inclined plane slides over the inner shell ratchets to prevent engagement of outer shell ratchets 34 with inner shell ratchets 72 during twisting for secured reengagement of safety closure 100 to the container.

In general, the number of outer shell ratchets 34 on inner surface 75 of upper portion 20 of outer shell 10 is the number sufficient to perform the required function of the ratchets, namely to aid in the removal of safety closure 100 from the container. The number of outer shell ratchets 34 on the embodiment shown in this disclosure is three. However, the number of outer shell ratchets 34 on other embodiments could be one or more, or two or more, or three or more, or four or more, or six or more. In some embodiments, one outer shell ratchet 34 may be sufficient to perform the function. One possible issue with one ratchet is the possibility of ratchet failure if the single ratchet is repeatedly subjected to the stress of removal. Therefore, sufficient redundancy should be strived for with respect to the number of outer shell ratchets 34. The maximum number of ratchets is limited by the size of safety closure 100, the need for outer shell ratchets 34 to be able to nest or engage with inner shell ratchets 72, and the need for using less total material in safety closure 100.

Outer shell side wings 36 are shown on the inner surface 85 of annular side wall 80 of outer shell 10, the outer shell side wings 36 having a shape and thickness "t". The function of side wings 36 is to engage with inner shell cams 74 (described below) on the lower portion 70 of inner shell 50 during reengagement of safety closure 100 to the container. As illustrated in FIG. 7, disposed adjacent outer shell side wings 36 on the inner surface 85 of annular side wall 80 of outer shell 10 are wing recess areas 38 which are adapted to (or, have a shape similar [or substantially similar] to that of the outer shell side wings 36 and a depth "t'" equal to [or substantially equal] to thickness "t" to receive the outer shell side wings 36 once the side wings are bent outwardly toward the inner surface 85 of annular side wall 80. The function of wing recess areas 38 is to provide space into which the outer shell side wings 36 can at least partially (or completely) bend, therefore reduce friction between side wings 36 and inner shell cams 74. This prevents the possibility of removing safety closure 100 without the downward force due to friction between side wings 36 and inner shell cams 74.

In general, the number of outer shell side wings 36 on the inner surface 85 of annular side wall 80 of outer shell 10 is the number sufficient to perform the required function of the wings, namely to aid in the reengagement of safety closure 100 to the container. The number of outer shell side wings 36 on the embodiment shown in this disclosure is six. However, the number of outer shell side wings 36 on other embodiments could be one or more, or two or more, or three or more, or four or more, or six or more, or eight or more. In some embodiments, one outer shell side wings 36 may be sufficient to perform the function. One possible issue with one wing is the possibility of wing failure if the single wing is repeatedly subjected to the stress of safety closure 100 removal from, and reengagement to, the container. Therefore, sufficient redundancy should be strived for with respect to the number of outer shell side wings 36. The maximum number of wings is limited by the size of safety closure 100, the need for outer shell side wings 36 to be able to interact with inner shell cams 74, and the need for using less total material in safety closure 100.

Outer shell retainer segment 42 is shown on the inner surface 85 of annular side wall 80 of outer shell 10. The function of outer shell retainer segment 42 is to nest with (or rotatably secure or retain) inner shell retainer segment 82 of the outer surface 90 of annular side wall 89 of inner shell 50 so that inner shell 50 can be nested and rotatably retained within outer shell 10. Though shown as a single circumferentially continuous element (a ring) in the figures, outer shell retainer segment 42 may be an interrupted element, or may include multiple spaced apart elements so long as the described retaining/securing function of outer shell retainer segment 42 is maintained.

Figure 2B:
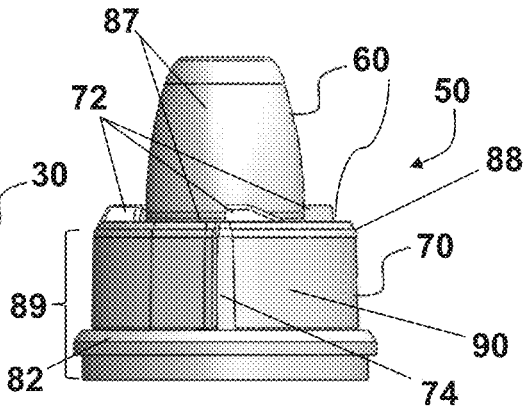
FIG. 2*b* is a side perspective view of the inner shell of the closure of FIG. 1.
Figure 3B:
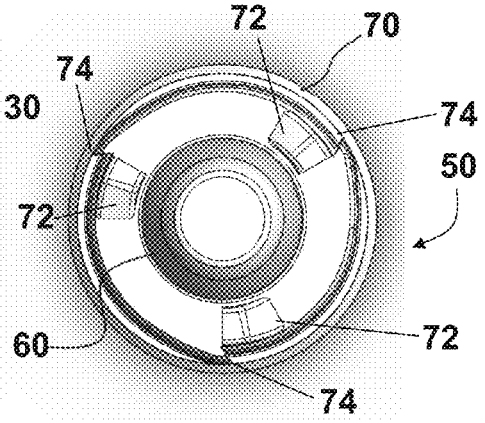
FIG. 3*b* is a top plan view of the inner shell of FIG. 2*b;*
Figure 4B:
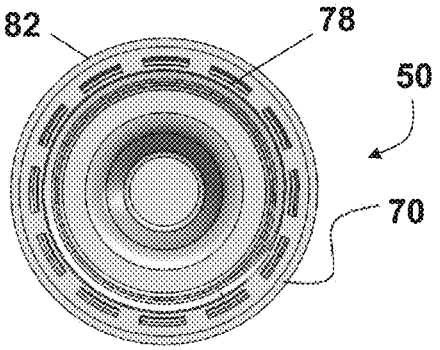
FIG. 4*b* is a bottom plan view of the inner shell of FIG. 2*b;*

Safety closure 100 also includes an inner shell 50. Inner shell 50 is shown in perspective view in FIG. 1, and in side, top, and bottom views in FIG. 2*b*, FIG. 3*b*, and FIG. 4*b*, respectively. In this embodiment, inner shell 50 has an upper portion 60 and a lower portion 70. The upper portion 60 of inner shell 50 has an outer surface 87. In certain embodiments, upper portion 60 is a substantially flat top wall of inner shell 50. In other embodiments, as shown in the figures, upper portion 60 is generally frustoconical in shape. The frustoconical shape of upper portion 60 in this embodiment serves as head space for a frustoconical eye dropper fitment coupled to the neck of the container to which safety closure 100 in coupled. The upper portion 60 contains one or more inner shell ratchets 72 projecting outwardly from the outer surface 87 of upper portion 60 of inner shell 50.

Lower portion 70 of inner shell 50 is defined by an annular side wall 89 depending downwardly from an outer periphery 88 formed by the upper portion 60 of inner shell 50. The annular side wall 89 having an outer surface 90 and an inner surface 91. The lower portion 70 is cylindrical in shape, and contains one or more inner shell cams 74 projecting outwardly from the outer surface 90 of annular side wall 89 of lower portion 70, and an inner shell retainer segment 82 on the outer surface 90 of the annular side wall 89 of lower portion 70 for rotatably engaging outer shell retainer segment 42 to maintain inner shell 50 in rotatable connection with the outer shell 10, and threads 76 on (and projecting inwardly from) the inner surface 91 of annular side wall 89 of lower portion 70. Lower portion 70 of inner shell 50 is cylindrical in shape as safety closure 100 will be rotated counter clockwise (CCW) during removal of safety closure 100 from the container, and clockwise (CW) during secured reengagement of safety closure 100 to the container.

In the embodiment shown on FIG. 1, slits 78 are located at the base of inner shell 50. These slits are optional, and may be used to decrease the total amount material used in the manufacture of safety closure 100.

Inner shell ratchets 72 are shown on the outer surface 87 of upper portion 60 of inner shell 50. The function of ratchets 72 is to engage with outer shell ratchets 34 on the inner surface 75 of upper portion 20 of outer shell 10 during removal of safety closure 100 from the container. In some embodiments, ratchets 72 are prism shaped. In the embodiment shown in this disclosure, ratchets 72 are shown as prism shaped with an inclined plane on one side and flat side opposite the inclined plane Inner shell ratchets 72 are positioned so that the flat side of inner shell ratchets 72 engage with the flat side of outer shell ratchets 34 to rotate the inner shell 50 for removal of safety closure 100 from the container. The side of the inner shell ratchets 72 having the inclined plane slides over the side of outer shell ratchets 34 having the inclined plane to prevent engagement of outer shell ratchets 34 with inner shell ratchets 72 during twisting for secured reengagement of safety closure 100 to the container.

In general, the number of inner shell ratchets 72 on outer surface 87 of upper portion 60 of inner shell 50 is the number sufficient to perform the required function of the ratchets, namely to aid in the removal of safety closure 100 from the container. The number of inner shell ratchets 72 on the embodiment shown in this disclosure is three. However, the number of inner shell ratchets 72 on other embodiments could be one or more, or two or more, or three or more, or four or more, or six or more. In some embodiments, one inner shell ratchet 72 may be sufficient to perform the function. One possible issue with one ratchet is the possibility of ratchet failure if the single ratchet is repeatedly subjected to the stress of removal. Therefore, sufficient redundancy should be strived for with respect to the number of inner shell ratchets 72. The maximum number of ratchets is limited by the size of safety closure 100, the need for inner shell ratchets 72 to be able to nest with outer shell ratchets 34, and the need for using less total material in safety closure 100.

Inner shell cams 74 are shown on the outer surface 90 of annular side wall 89 of lower portion 70. The function of inner shell cams 74 is to lock with side wings 36 on the lower portion 30 of outer shell 10 during reengagement of safety closure 100 to the container.

In general, the number of inner shell cams 74 on the outer surface 90 of annular side wall 89 of lower portion 70 is the number sufficient to perform the required function of the cams, namely to aid in the reengagement of safety closure 100 to the container. The number of inner shell cams 74 on the embodiment shown in this disclosure is three. However, the number of inner shell cams 74 on other embodiments could be one or more, or two or more, or three or more, or four or more, or six or more, or eight or more. In some embodiments, one inner shell cams 74 may be sufficient to perform the function. One possible issue with one cam is the possibility of cam failure if the single cam is repeatedly subjected to the stress of safety closure 100 removal from, and reengagement to, the container. Therefore, sufficient redundancy should be strived for with respect to the number of inner shell cams 74. The maximum number of cams is limited by the size of safety closure 100, the need for inner shell cams 74 to be able to interact with side wings 36, and the need for using less total material in safety closure 100.

Threads 76 are shown on the inner surface 91 of annular side wall 89 of lower portion 70. The threads 76 are used to attach of safety closure 100 onto the container. The properties (lead and pitch) of the threads would be the properties standard to the closure industry.

Inner shell retainer segment 82 is shown on the outer surface of lower portion 30 of outer shell 10. The function of inner shell retainer segment 82 is to nest with (or, be rotatably secured or retained) by outer shell retainer segment 42 on the inner surface of lower portion 30 of outer shell 10. Though shown as a single circumferentially continuous element (a ring) in the figures, inner shell retainer segment 82 may be an interrupted element, or may include multiple spaced apart elements so long as inner shell retainer segment 82 is rotatably retained/secured by outer shell retainer segment 42.

It is conceivable that in some embodiments, outer shell 10 and inner shell 50 will comprise only one (or a single) interconnected or integral portion. In those embodiments, outer shell 10 will comprise the elements described above for upper portion 20 and lower portion 30 of outer shell 10, while inner shell 50 will comprise the elements described above for upper portion 60 and lower portion 70 of inner shell 50.

Safety closure 100 is assembled by axially inserting inner shell 50 into outer shell 10. As mentioned previously, inner shell retainer segment 82 will nest with outer shell retainer segment 42 and inner shell 50 will be retained within outer shell 10.

Figure 5B:
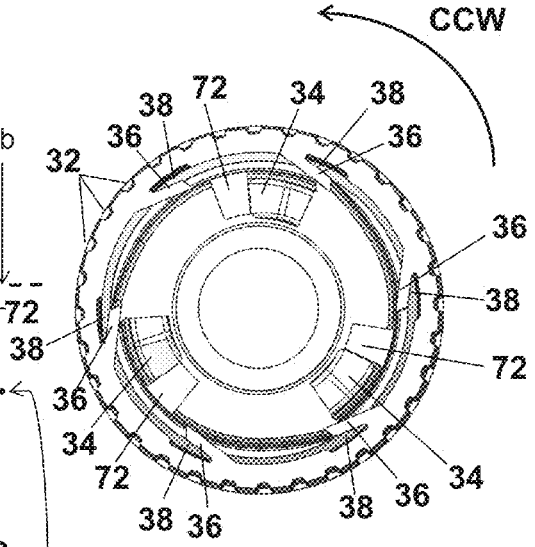
FIG. 5*b* is a top cross-sectional view of the safety closure of the present invention along lines 5*b* of FIG. 5*a* when a user is attempting to remove the closure from a container.

FIGS. 5*a*, 5*b*, 6*a*, and 6*b* describe the operation of safety closure 100. FIG. 5*a* is a fragmentary cross-sectional view of safety closure 100 along its length axis when a user is attempting to remove the closure from a container, while FIG. 5*b* is a cross-sectional view of safety closure 100 perpendicular to its length axis when a user is attempting to remove the closure from a container.

To remove safety closure 100, the user applies a force in the direction shown as "D" on FIG. 5*a*. When applying force "D", the spring mechanism 22 of outer shell 10 deforms temporally and allows outer shell ratchets 34 is to engage with inner shell ratchets 72 as safety closure 100 is rotated counter clockwise (CCW, as shown on FIG. 5*b*) during removal of safety closure 100 from the container. The engagement transfers the torque from outer shell 10 to inner shell 50 as the assembled safety closure 100 is removed. Without force "D", outer shell ratchets 34 and inner shell ratchets 72 will not engage, and a child will not be able to remove safety closure 100 from the container. While safety closure 100 is rotated counter clockwise, outer shell side wings 36 of outer shell 10 do not engage with inner shell cams 74 on inner shell 50. Wing recessed areas 38 behind side wings 36 provide space into which outer shell side wings 36 can bend, therefore reducing friction between side wings 36 and inner shell cams 74. This prevents the possibility of removing safety closure 100 without the force "D" due to no engagement between side wings 36 and inner shell cams 74.

Figure 6B:
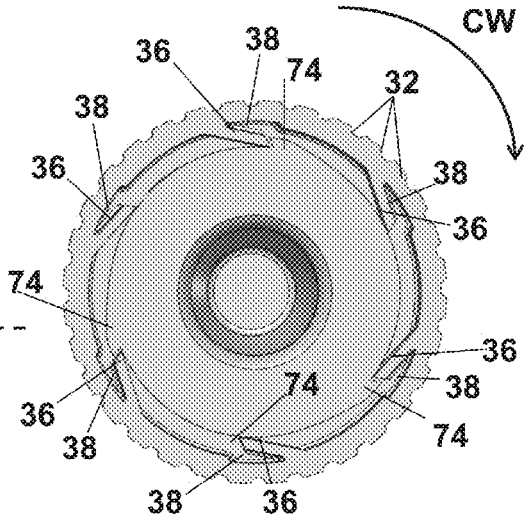
FIG. 6*b* is a bottom cross-sectional view of the safety closure of the present invention along lines 6*b* of FIG. 6*a* when a user is attempting to reengage the closure to a container.

FIG. 6*a* is a fragmentary cross-sectional view of the assembled safety closure 100 along its length axis when a user is attempting to reengage the closure to a container, while FIG. 6*b* is a cross-sectional view of safety closure 100 along lines 6*b* of FIG. 6*a* when a user is attempting to reengage the closure to a container.

To reengage safety closure 100, the downward force is not necessary. As safety closure 100 is rotated clockwise (CW, as shown on FIG. 6*b*), outer side wings 36 engage with inner shell cams 74. The engagement transfers the torque from outer shell 10 to inner shell 50 as the assembled safety closure 100 is reengaged to the container.

Inner shell 50 and outer shell 10 of safety closure 100 can be made of any number of commonly used materials for such devices. Commonly, polymers or plastics may be used. Some of the common polymers or plastics include, but are not limited to: High Density Polyethylene (HDPE), Low Density Polyethylene (LDPE), Polyethylene Terephthalate (PET, PETE or polyester), Polyvinyl Chloride (PVC), Polypropylene (PP), or Polystyrene (PS).

This invention will be better understood from the experimental details that follow. However, one skilled in the art will readily appreciate that the specific method and results discussed are merely illustrative of the invention and no limitation of the invention is implied.

EXAMPLES

Safety closures were manufactured using conventional injection molding techniques. Four cavity molds of each of the outer shell and inner shell were fabricated and samples were manufactured using the injection molding machine-model Allrounder 470a from Arburg. The inner and outer shell samples were aligned and snapped together by hand, but would be assembled with an automated process. The assembled closure samples were tested for child resistance on small plastic dropper containers ranging in sizes of 8 ml, 15 ml, 19 ml and 30 ml to demonstrate the child-resistant function of the closures as required per 16 CFR 1700. For the inner shell, Polypropylene (PP) was the material molded. For the outer shell, High Density Polyethylene (HDPE) was used. The dimensions of the molded inner shells were 18.2 millimeter (mm) as the diameter of the inner shell lower portion, and 19.39 millimeter (mm) as the height of the inner shell. The molded inner shells weighed about 0.9 grams. The dimensions of the molded outer shells were 21.2 millimeter (mm) as the diameter of the outer shell lower portion, and 23.9 millimeter (mm) as the height of the outer shell. The molded outer shell weighed approximately 1.75 grams. Over 500 samples of the safety closures were manufactured and tested as described and passed the child resistant test.

What is claimed is:

1. A closure comprising:

an inner shell comprising:

a. a first upper portion having an outer surface; and b. a first lower portion comprising an annular side wall depending downwardly from an outer periphery formed by the first upper portion, the annular side wall of the first lower portion having an outer surface and a first inner surface, the outer surface of the first lower portion comprising one or more inner shell cams projecting outwardly from the outer surface;

an outer shell rotatably housing the inner shell, the outer shell comprising:

a. a second upper portion having an inner surface, wherein the second upper portion contains a spring mechanism projecting inwardly from the inner surface of the second upper portion to contact the inner shell and permit automatically reversible movement of the outer shell relative to inner shell;

b. a second lower portion comprising an annular side wall depending downwardly from an outer periphery formed by the second upper portion, the annular side wall having a second inner surface comprising:

i. outer shell side wings projecting inwardly from the second inner surface and disposed substantially within a plane for engaging one or more inner shell cams, the plane defining an acute angle with the second inner surface, the side wings bendable outwardly toward the second inner surface, wherein the outer shell is reversibly movable from a first non-engagement position to a second engagement position relative to the inner shell; and ii. wing recess areas disposed within the second inner surface and adjacent to the outer shell side wings to receive the outer shell side wings once the outer shell side wings are bent outwardly toward the second inner surface.

2. The closure according to claim 1 wherein the spring mechanism comprises at least one hinge.

3. The closure according to claim 1 wherein the first upper portion comprises one or more inner shell ratchets projecting outwardly from the outer surface of the upper portion.

4. The closure according to claim 3 wherein the second upper portion comprises one or more outer shell ratchets inwardly projecting from the inner surface of the second upper portion.

* * * * *